US012004567B2

(12) United States Patent
Lee et al.

(10) Patent No.: US 12,004,567 B2
(45) Date of Patent: Jun. 11, 2024

(54) AEROSOL GENERATING DEVICE AND AEROSOL GENERATING SYSTEM

(71) Applicant: KT&G CORPORATION, Daejeon (KR)

(72) Inventors: Seung Won Lee, Gyeonggi-do (KR); Yong Hwan Kim, Gyeonggi-do (KR); Sung Wook Yoon, Gyeonggi-do (KR); Dae Nam Han, Seoul (KR)

(73) Assignee: KT&G CORPORATION, Daejeon (KR)

( * ) Notice: Subject to any disclaimer, the term of this patent is extended or adjusted under 35 U.S.C. 154(b) by 661 days.

(21) Appl. No.: 17/268,273

(22) PCT Filed: Dec. 9, 2020

(86) PCT No.: PCT/KR2020/017920
§ 371 (c)(1),
(2) Date: Feb. 12, 2021

(87) PCT Pub. No.: WO2021/162224
PCT Pub. Date: Aug. 19, 2021

(65) Prior Publication Data

US 2022/0408822 A1 Dec. 29, 2022

(30) Foreign Application Priority Data

Feb. 14, 2020 (KR) ..... 10-2020-0018554

(51) Int. Cl.
*A24F 40/465* (2020.01)
*A24F 40/51* (2020.01)

(52) U.S. Cl.
CPC ..... *A24F 40/465* (2020.01); *A24F 40/51* (2020.01)

(58) Field of Classification Search
CPC ..... A24F 40/465
See application file for complete search history.

(56) References Cited

U.S. PATENT DOCUMENTS 9,717,277 B2 8/2017 Mironov
11,324,259 B2 * 5/2022 Courbat ..... H05B 6/108
(Continued)

FOREIGN PATENT DOCUMENTS

JP 2018-529324 A 10/2018
KR 10-2018-0034640 A 4/2018
(Continued)

OTHER PUBLICATIONS

Extended European Search Report dated Oct. 15, 2021 in Application No. 20861982.5.
(Continued)

*Primary Examiner* — Neil Abrams
(74) *Attorney, Agent, or Firm* — Sughrue Mion, PLLC

(57) ABSTRACT

An aerosol generating device includes: an opening configured to receive a cigarette, an accommodation space configured to accommodate the cigarette inserted through the opening, a coil surrounding the accommodation space and configured to generate an induced magnetic field, a susceptor configured to generate heat due to the induced magnetic field generated from the coil, a heat dissipating structure surrounding the coil and having a double wall structure including a vacuum inner space, a shielding portion configured to block the induced magnetic field generated from the coil and disposed between the coil and the heat dissipating structure, a cigarette recognition sensor configured to detect changes in inductance of the cigarette recognition sensor which is generated by insertion or extraction of the cigarette, and a controller configured to determine whether the cigarette is inserted or extracted, based on the changes in inductance.

14 Claims, 8 Drawing Sheets

(56) References Cited

U.S. PATENT DOCUMENTS

| | | | | |
|---|---|---|---|---|
| 2017/0055580 | A1* | 3/2017 | Blandino | H05B 6/36 |
| 2017/0055583 | A1 | 3/2017 | Blandino et al. | |
| 2019/0182909 | A1 | 6/2019 | Fursa et al. | |
| 2019/0191767 | A1 | 6/2019 | Wu et al. | |
| 2019/0274354 | A1* | 9/2019 | Sur | A61M 15/06 |
| 2020/0054069 | A1 | 2/2020 | Blandino et al. | |
| 2020/0093177 | A1 | 3/2020 | Han et al. | |
| 2020/0268053 | A1* | 8/2020 | Thorsen | A24F 40/465 |
| 2021/0378307 | A1* | 12/2021 | Reevell | A24F 40/70 |
| 2022/0408821 | A1* | 12/2022 | Yoon | A24F 40/20 |
| 2022/0408822 | A1* | 12/2022 | Lee | H05B 6/108 |

FOREIGN PATENT DOCUMENTS

| | | | |
|---|---|---|---|
| KR | 10-2018-0070436 | A | 6/2018 |
| KR | 10-2019-0035949 | A | 4/2019 |
| KR | 10-2019-0039713 | A | 4/2019 |
| WO | 2015/062983 | A2 | 5/2015 |
| WO | 2018/041450 | A1 | 3/2018 |
| WO | 2019/053268 | A1 | 3/2019 |

OTHER PUBLICATIONS

Notice of Reasons for Refusal dated Jun. 28, 2022 from the Japanese Patent Office in Japanese Application No. 2021-521202.
International Search Report dated Mar. 22, 2021 in International Application No. PCT/KR2020/017920.

* cited by examiner

[Fig. 1]
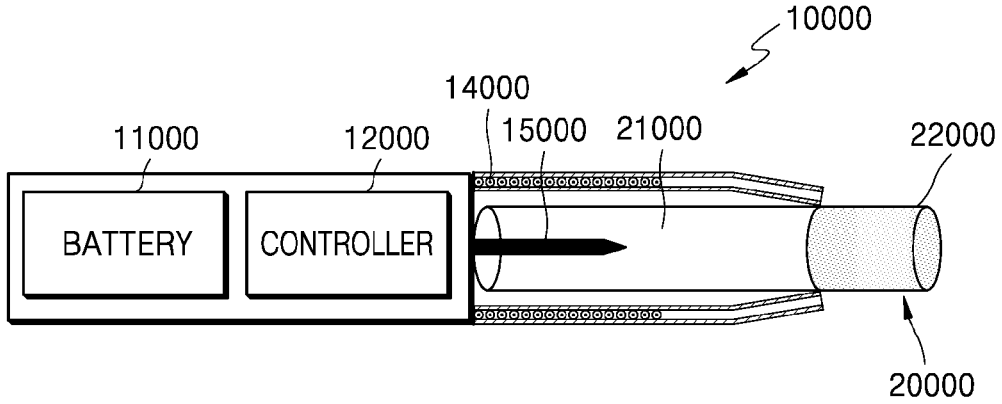
[Fig. 2]
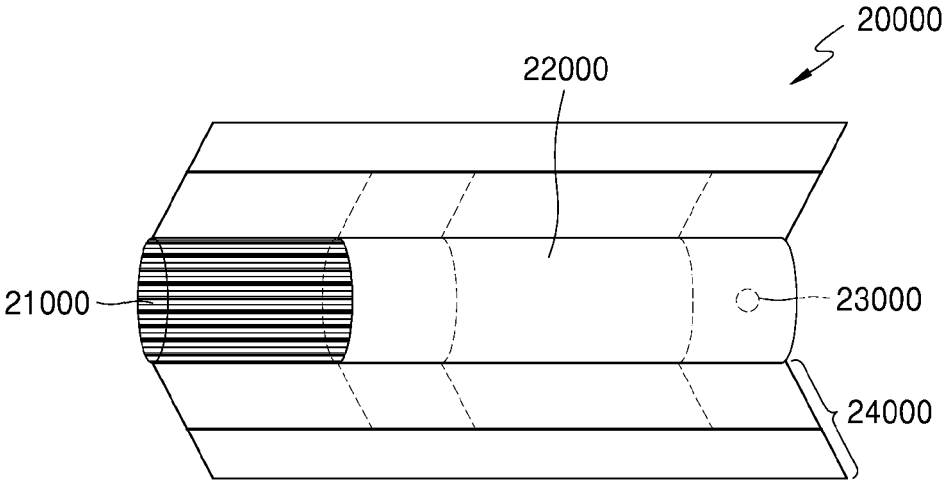

[Fig. 3]
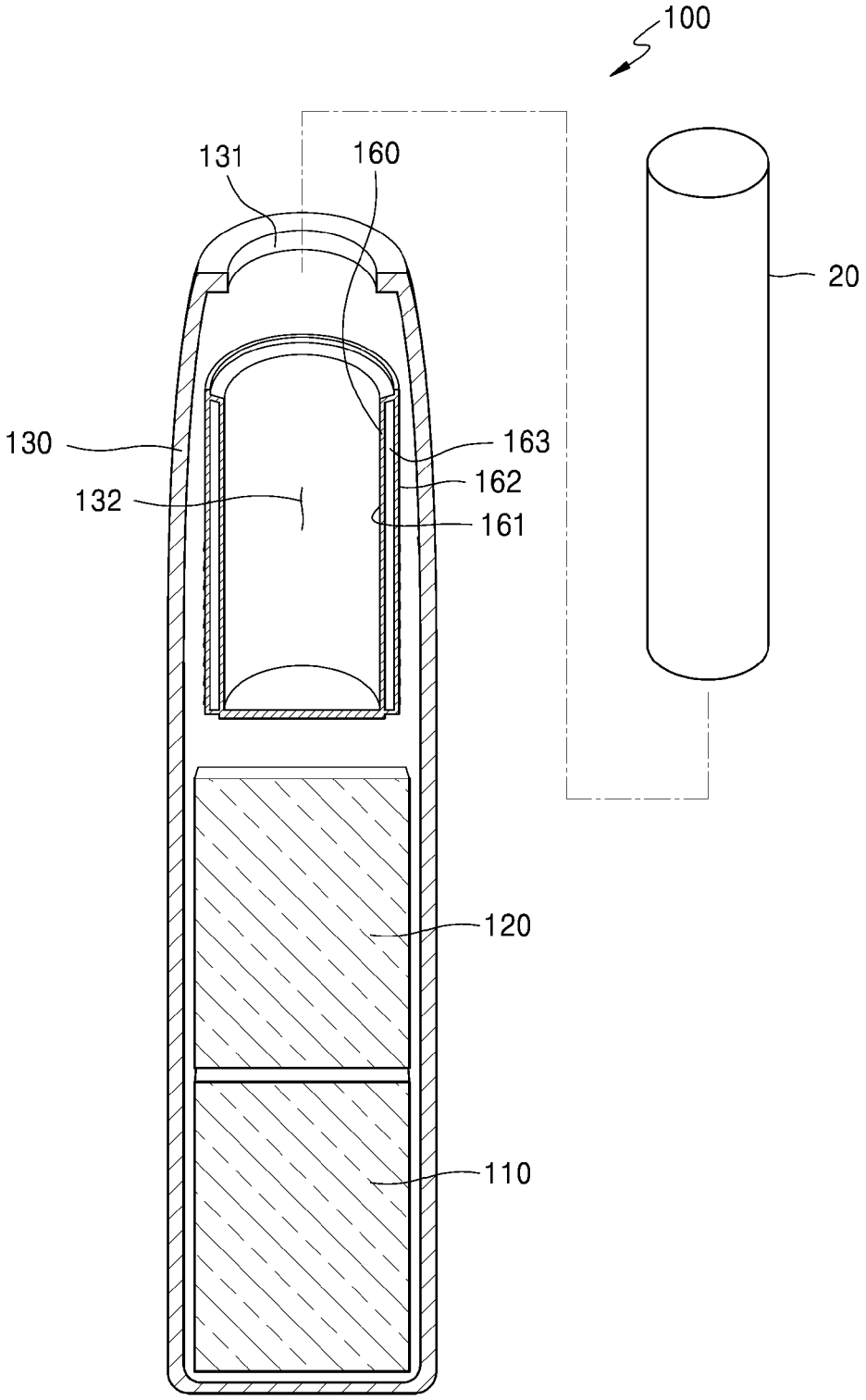

[Fig. 4A]
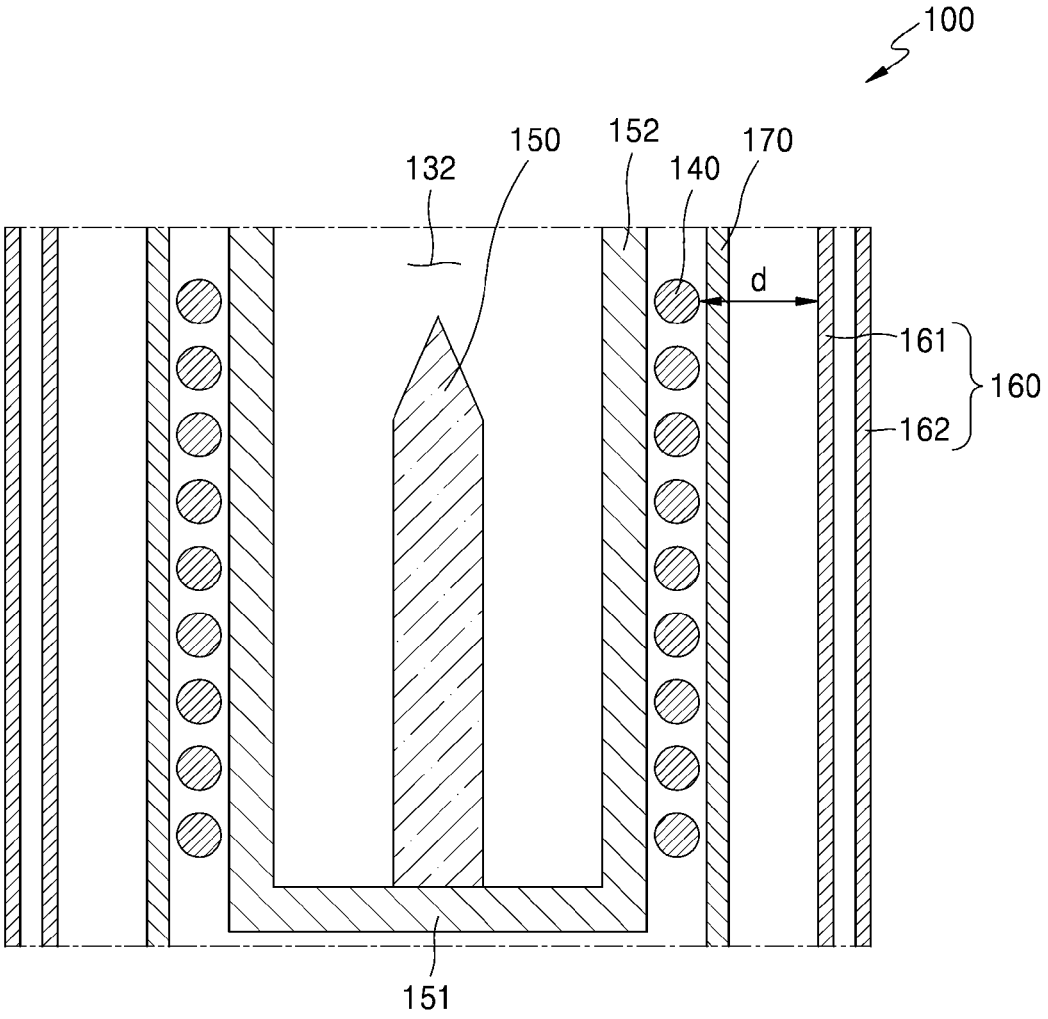

[Fig. 4B]
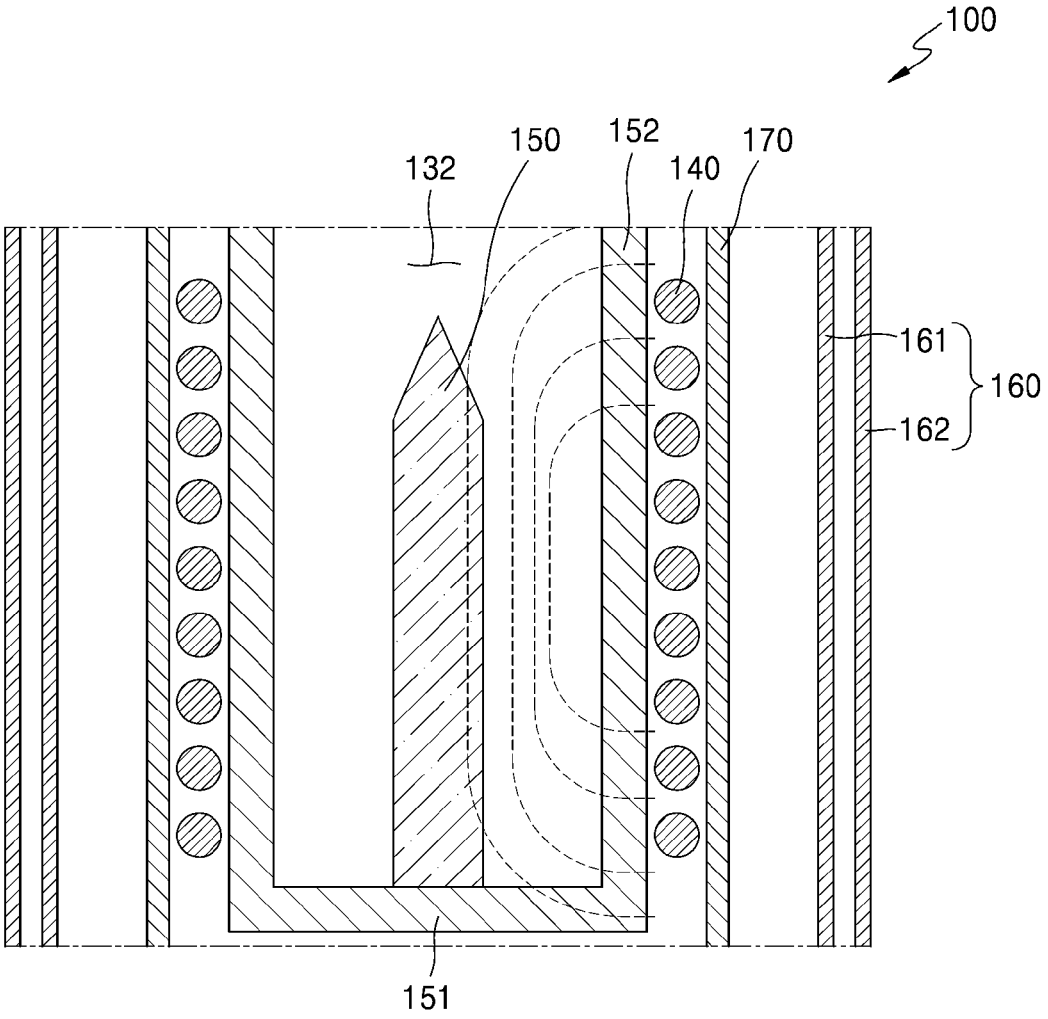

[Fig. 4C]
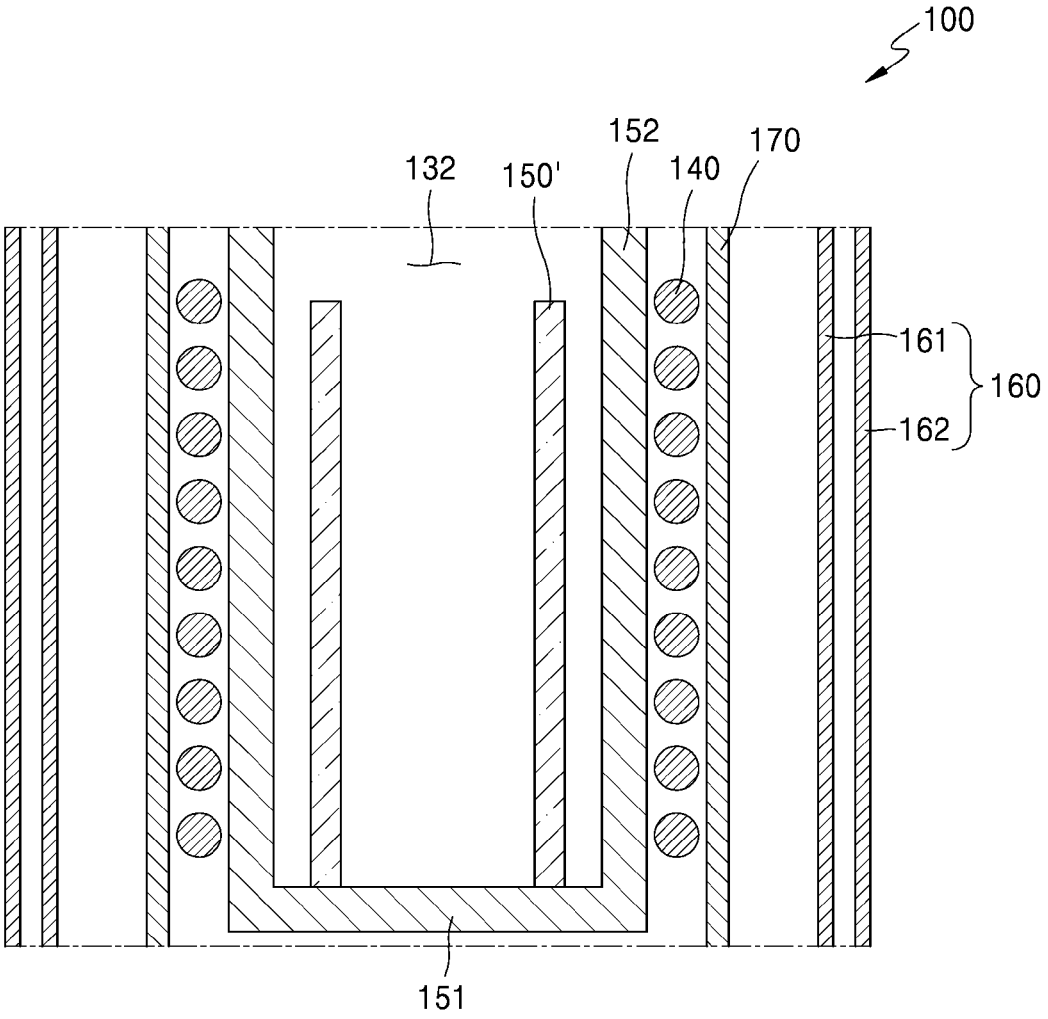

[Fig. 5A]
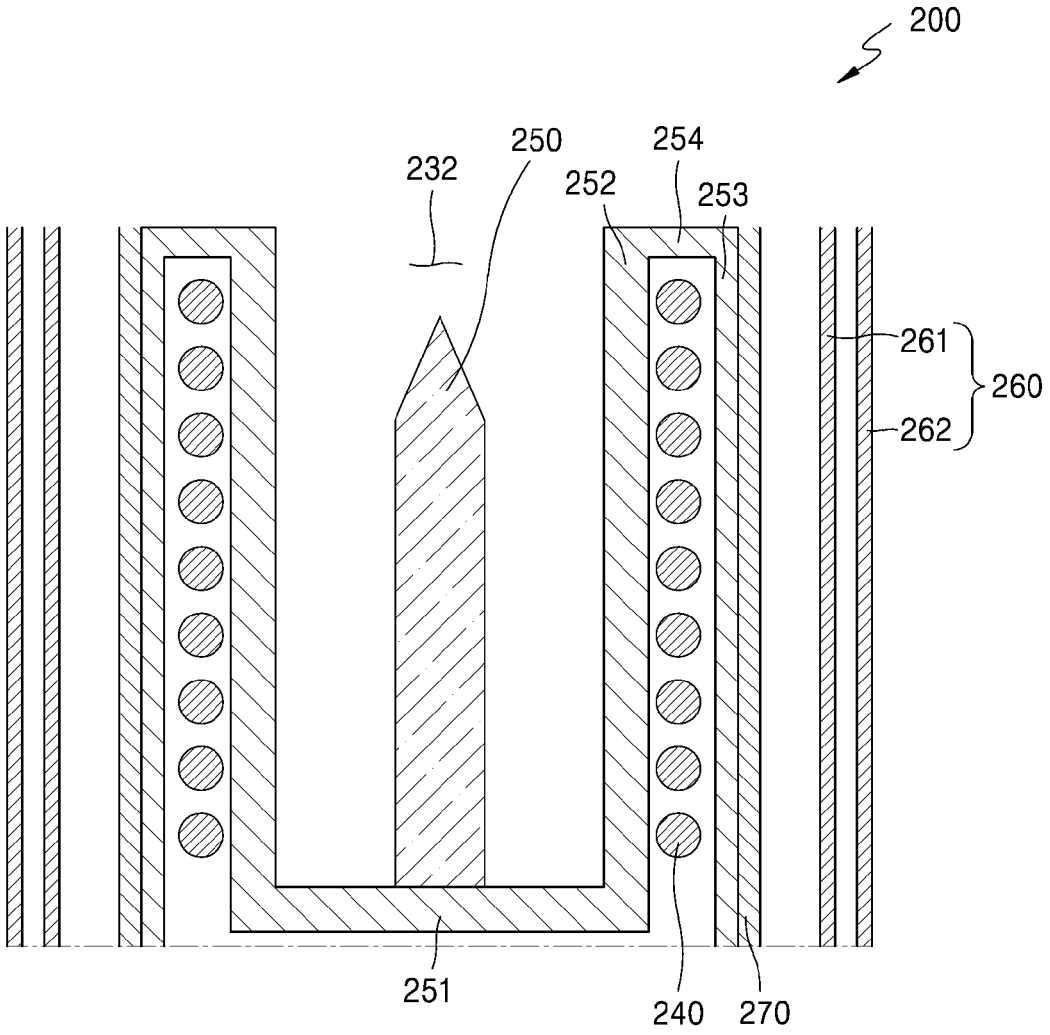

[Fig. 5B]
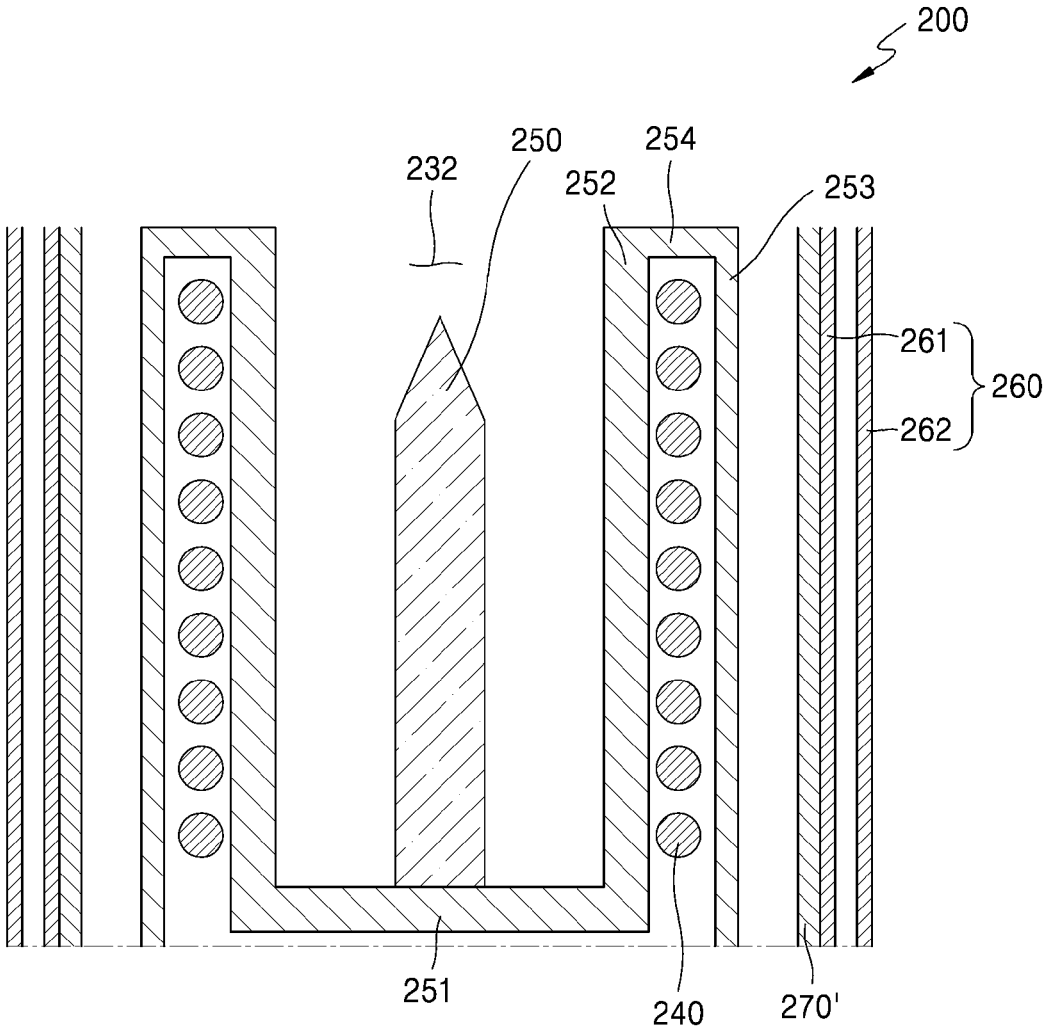

[Fig. 6]
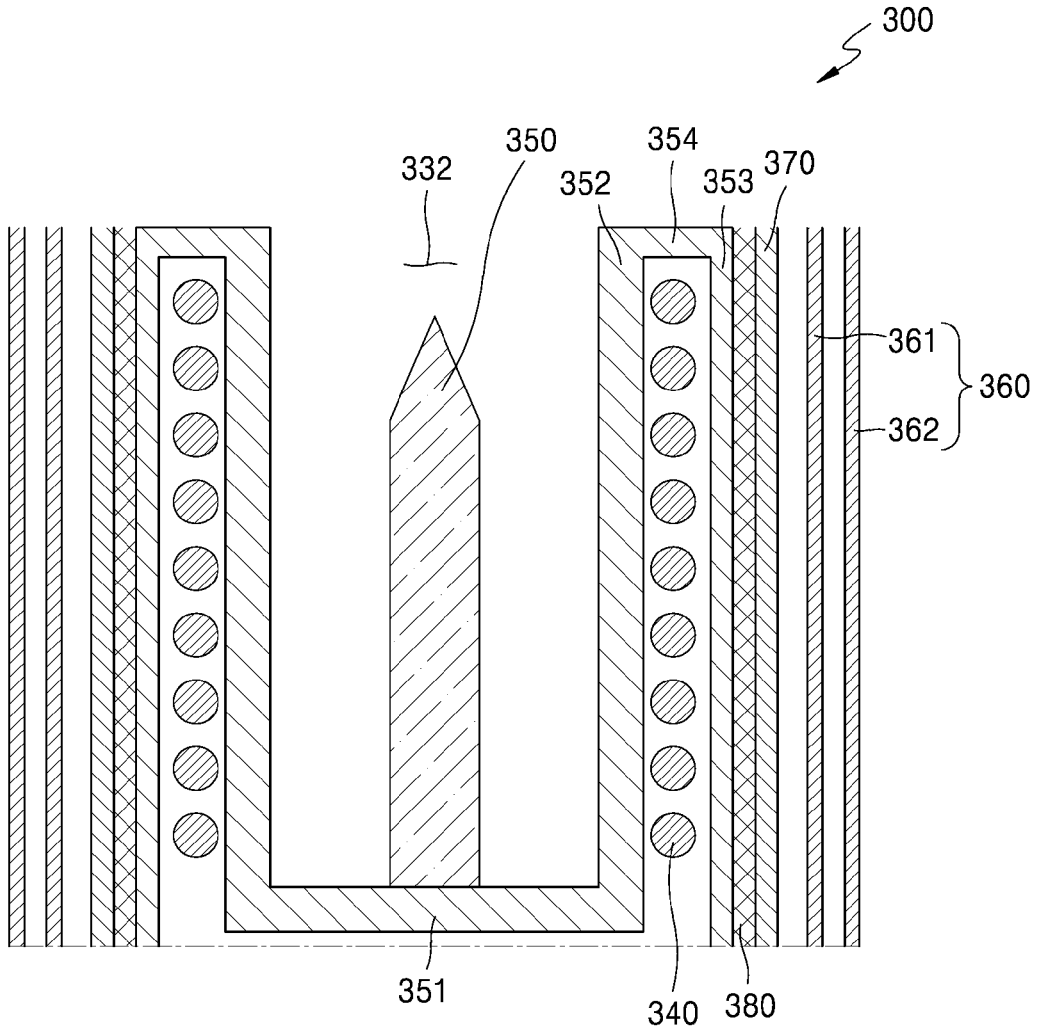

AEROSOL GENERATING DEVICE AND AEROSOL GENERATING SYSTEM

CROSS REFERENCE TO RELATED APPLICATIONS

This application is a National Stage of International Application No. PCT/KR2020/017920 filed Dec. 9, 2020, claiming priority based on Korean Patent Application No. 10-2020-0018554 filed Feb. 14, 2020.

TECHNICAL FIELD

One or more embodiments relate to an aerosol generating device and an aerosol generating system, and more particularly, to an aerosol generating device and an aerosol generating system including a heat dissipating structure and a shielding portion that may prevent heat and electromagnetic waves from being transferred to the outside of a device.

BACKGROUND ART

Recently, the demand for alt native methods to overcome the shortcomings of traditional combustive cigarettes has increased. For example, there is an increasing demand for a device that generates aerosols by heating an aerosol generating material, rather than by combusting cigarettes. Accordingly, studies on a heating-type cigarette or a heating-type aerosol generating device have been actively conducted.

DISCLOSURE OF INVENTION

Technical Problem

An aerosol generating device according to the related art heats a cigarette through a heater, and a user inhales an aerosol through the heated cigarette. The user may hold the aerosol generating device during smoking, and heat dissipated from the heater of the aerosol generating device may be transferred to the user. In addition, in the case of the aerosol generating device that uses an induction heating method, electromagnetic waves may be transferred to the outside.

Solution to Problem

One or more embodiments include an aerosol generating device and an aerosol generating system that may solve the above-described problems of an aerosol generating device according to the related art.

Solutions to be solved through embodiments are not limited to the above-described solutions, and solutions that are not mentioned will be clearly understood by those of ordinary skill in the art from the present specification and the accompanying drawings.

According to one or more embodiments, an aerosol generating device includes an opening configured to receive a cigarette; an accommodation space configured to accommodate the cigarette inserted through the opening; a coil surrounding the accommodation space and configured to generate an induced magnetic field; a susceptor configured to generate heat due to the induced magnetic field generated from the coil; a heat dissipating structure surrounding the coil and having a double, wall structure including a vacuum inner space; and a shielding portion configured to block the induced magnetic field generated from the coil and disposed between the coil and the heat dissipating structure.

According to one or more embodiments, an aerosol generating system includes a cigarette including an aerosol generating material and an aerosol generating device configured to accommodate the cigarette and comprising: an opening configured to receive the cigarette; an accommodation space configured to accommodate the cigarette inserted through the opening; a coil surrounding the accommodation space and configured to generate an induced magnetic field; a susceptor configured to generate heat due to the induced magnetic field generated from the coil; a heat dissipating structure surrounding the coil and having a double wall structure including a vacuum inner space; and a shielding portion configured to block the induced magnetic field generated from the coil and disposed between the coil and the heat dissipating structure.

Advantageous Effects of Invention

An aerosol generating device according to one or more embodiments includes a shielding portion and a heat dissipating structure so that heat dissipated from a susceptor may be effectively prevented from being transferred to a user. Also, electromagnetic waves may be effectively prevented from being transferred to the outside of the aerosol generating device.

In addition, since an induced magnetic field may be concentrated to the susceptor, the heating efficiency of the susceptor may be maximized.

The effects by embodiments are not limited to the above-described effects, and effects that are not mentioned will be clearly understood by those of ordinary skill in the art from the present specification and the accompanying drawings.

BRIEF DESCRIPTION OF DRAWINGS

FIG. 1 is a diagram illustrating an example in which a cigarette is inserted into an aerosol generating device.

FIG. 2 shows a view showing an example of a cigarette.

FIG. 3 is a cross-sectional perspective view of an aerosol generating device according to an embodiment.

FIG. 4A is a detailed cross-sectional view a portion of an aerosol generating device shown in FIG. 3.

FIG. 4B illustrates an induced magnetic field in the embodiment shown in FIG. 4A.

FIG. 4C is a detailed cross-sectional view of a portion of an aerosol generating device according to another embodiment.

FIG. 5A is a detailed cross-sectional view of a portion of an aerosol generating device according to another embodiment.

FIG. 5B is a detailed cross-sectional view of a portion of an aerosol generating device according to another embodiment.

FIG. 6 is a detailed cross-sectional view of a portion of an aerosol generating device according to another embodiment.

BEST MODE FOR CARRYING OUT THE INVENTION

According to an embodiment, an aerosol generating device comprising: an opening configured to receive a cigarette; an accommodation space configured to accommodate the cigarette inserted through the opening; a coil surrounding the accommodation space and configured to generate an induced magnetic field; a susceptor configured to generate heat due to the induced magnetic field generated from the coil; a heat dissipating structure surrounding the coil and having a double wall structure including a vacuum inner space; and a shielding portion configured to block the induced magnetic field generated from the coil and disposed between the coil and the heat dissipating structure.

The shielding portion may be adjacent to the coil.

The aerosol generating device may further include: a support configured to support the susceptor; and a first support wall connected to the support and forming the accommodation space, wherein the coil surrounds the first support wall.

The aerosol generating device may further include a second support wall apart from and arranged outside the first support wall such that a coil accommodation space is formed between the first support wall and the second support wall, wherein the coil is arranged in the coil accommodation space.

The shielding portion may be adjacent to the second support wall.

The shielding portion may be adjacent to the heat dissipating structure.

A distance between the coil and the heat dissipating structure may be 1 mm to 2 mm.

The heat dissipating structure may include a metal material.

The metal material of the heat dissipating structure may be a paramagnetic substance.

The aerosol generating device may further include: a cigarette recognition sensor configured to detect changes in inductance of the cigarette recognition sensor which is generated by insertion or extraction of the cigarette; and a controller configured to determine whether the cigarette is inserted or extracted, based on the changes in inductance.

The cigarette recognition sensor may be arranged between the coil and shielding portion.

The aerosol generating device may further include a battery configured to supply power to the coil, wherein the controller is further configured to control the power supplied to the coil based on insertion or extraction of the cigarette.

According to an embodiment, an aerosol generating system may include: a cigarette comprising an aerosol generating material; and an aerosol generating device configured to accommodate the cigarette and comprising: an opening configured to receive the cigarette; an accommodation space configured to accommodate the cigarette inserted through the opening; a coil surrounding the accommodation space and configured to generate an induced magnetic field; a susceptor configured to generate heat due to the induced magnetic field generated from the coil; a heat dissipating structure surrounding the coil and having a double wall structure including a vacuum inner space; and a shielding portion configured to block the induced magnetic field generated from the coil and disposed between the coil and the heat dissipating structure.

The aerosol generating system may further include: a cigarette recognition sensor arranged between the shielding portion and the coil and configured to detect changes in inductance of the cigarette recognition sensor which is generated by insertion or extraction of the cigarette; and a controller configured to determine whether the cigarette has been inserted or extracted, based on the changes in inductance.

The cigarette may include an electromagnetic inducer configured to change the inductance of the cigarette recognition sensor.

Mode for the Invention

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, h, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a diagram illustrating an example in which a cigarette is inserted into an aerosol generating device.

Referring to FIG. 1, the aerosol generating device 10000 may include a battery 11000, a controller 12000, a coil 14000, and a susceptor 15000. Also, a cigarette 20000 may be inserted into an inner space of the aerosol generating device 10000.

FIG. 1 only shows an example embodiment of the aerosol generating device 10000. Therefore, it will be understood by one of ordinary skill in the art that other components may be further included in the aerosol generating device 10000, in addition to the components illustrated in FIG. 1.

FIG. 1 illustrates that the battery 11000, the controller 12000, and the susceptor 15000 are arranged in series. But, the embodiments are not limited to the structure shown in FIG. 1. In other words, according to the design of the aerosol generating device 10000, the battery 11000, the controller 12000, and the susceptor 15000 may be differently arranged.

When the cigarette 20000 is inserted into the aerosol generating device 10000, the aerosol generating device 10000 may heat the cigarette 20000 by an induction heating method. The temperature of aerosol generating material within the cigarette 20000 increases by heated susceptor 15000, and as a result, generates aerosol. The aerosol generated from cigarette 20000 is delivered to a user by passing through a filter rod 22000 of the cigarette 20000, which will be described later.

As necessary, even when the cigarette 20000 is not inserted into the aerosol generating device 10000, the aerosol generating device 10000 may heat the susceptor 15000.

The battery 11000 supplies electric power to be used for the aerosol generating device 10000 to operate. For example, the battery 11000 may supply power to the coil in order to heat the susceptor 15000, and may supply power for operating the controller 12000. Also, the battery 11000 may supply power for operations of a display, a sensor, a motor, and etc. mounted in the aerosol generating device 10000.

The controller 12000 may generally control operations of the aerosol generating device 10000. For example, the controller 12000 may control power supplied to the coil 14000, In detail, the controller 12000 may control not only operations of the battery 11000 and the coil 14000, but also operations of other components included in the aerosol generating device 10000. Also, the controller 12000 may check a state of each of the components of the aerosol generating device 10000 to determine whether or not the aerosol generating device 10000 is able to operate.

The controller 12000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

In the embodiment shown in FIG. 1, a coil 14000 of an aerosol generating device 10000 may be wound around a space in which the cigarette 20000 is accommodated, to generate an induced magnetic field, and the susceptor 15000 may be arranged in a position corresponding to the position of the coil 14000 to generate heat by the induced magnetic field generated from the coil 14000.

The induction heating method may refer to a method of generating heat from a magnetic body by applying an alternating magnetic field that periodically changes in direction to the magnetic body that generates heat due to an external magnetic field. A magnetic body that generates heat due to an external magnetic field may be a susceptor. The susceptor may be arranged in the cigarette 20000 in a shape of a piece, flake or strip. Also, the susceptor may be arranged in the aerosol generating device 10000 instead of being included in the cigarette.

When an alternating magnetic field is applied to a magnetic body, energy loss due to eddy current loss and hysteresis loss may occur in the magnetic body, and the lost energy may be released from the magnetic body as thermal energy. As an amplitude or a frequency of the alternating magnetic field applied to the magnetic body increases, more heat energy may be released from the magnetic body. The aerosol generating device 10000 may release thermal energy from a magnetic body by applying an alternating magnetic field to the magnetic material and may transmit the thermal energy released from the magnetic body to the cigarette 20000.

According to embodiments, the susceptor 15000 may include metal or carbon. The susceptor 15000 may include at least one of ferrite, ferromagnetic alloy, stainless steel, and aluminum (Al), In addition, the susceptor 15000 may include at least one of a ceramic such as graphite, molybdenum, silicon carbide, niobium, nickel alloy, metal film, or zirconia, a transition metal such as nickel (Ni) or cobalt (Co), and a metalloid such as boron (B) or phosphorus (P).

As the susceptor 15000 is provided in the aerosol generating device 10000 rather than an inside of a cigarette, there may be various advantages. For example, when a susceptor material is not uniformly distributed inside the cigarette, a problem may be solved in which an aerosol and flavor are generated non-uniformly. In addition, the susceptor 15000 is provided in the aerosol generating device 10000, and thus, a temperature of the susceptor 15000 that generates heat by induction heating may be directly measured and provided to the aerosol generating device 10000, and accordingly, the temperature of the susceptor 15000 may be precisely controlled.

The coil 14000 may receive power from the battery 11000 as explained in the above. The controller 12000 of the aerosol generating device 10000 may generate a magnetic field by controlling an electrical current flowing through the coil 14000, and an induced electrical current may be generated in the susceptor 15000 due to an influence of the magnetic field. Such an induction heating phenomenon is a known phenomenon described by Faraday's Law of induction and Ohm's Law, and refers to a phenomenon in which an electric field that changes when magnetic induction in a conductor changes, is generated in the conductor.

As such, as an electric field is generated in a conductor, an eddy current flows in the conductor according to Ohm's law, and the eddy current generates heat proportional to current density and conductor resistance.

In other words, when power is supplied to the coil 14000, a magnetic field may be generated inside the coil 14000. When an alternating current is applied to the coil 14000 from the battery 11000, the magnetic field formed inside the coil 14000 may change in direction periodically. When the susceptor 15000 is disposed inside the coil 14000 and exposed to an alternating magnetic field that periodically changes in direction, the susceptor 15000 generates heat to heat the cigarette 20000 accommodated in the aerosol generating device 10000.

When the alternating magnetic field formed by the coil 14000 changes in amplitude or frequency, the susceptor 15000 that heats the cigarette 20000 may also change in temperature. The controller 12000 may control the power supplied to the coil 14000 to adjust the amplitude or the frequency of the alternating magnetic field formed by the coil 14000, and thus, the temperature of the susceptor 150000 may be controlled.

For example, the coil 14000 may be implemented as a solenoid. A material of a wire used for the solenoid may be copper (Cu). However, the material is not limited thereto, and any one of silver (Ag), gold (Au), aluminum (Al), tungsten (W), zinc (Zn), and nickel (Ni), or an alloy containing at least one of the materials will be used as a material of a wire used for a solenoid as a material with a low resistance value to allow a high current to flow.

On the other hand, as another example, the aerosol generating device 10000 may heat the cigarette 20000 by an electric resistive heater. For example, when the cigarette 20000 is inserted into the aerosol generating device 10000, instead of the susceptor 15000, the electric resistive heater may be located inside the cigarette 20000. The heated heater may generate an aerosol by raising the temperature of an aerosol generating material in the cigarette 20000.

For example, the electric resistive heater may include an electrically conductive track, and the heater may be heated when currents flow through the electrically conductive track. However, the heater is not limited to the example described above and may include all heaters which may be heated to a desired temperature. Here, the desired temperature may be pre-set in the aerosol generating device 10000 or may be manually set by a user.

The susceptor 15000 is shown to be inserted inside the cigarette 20000 in FIG. 1, but not limited thereto. For example, the susceptor 15000 may include a tube-type heating element, a plate-type heating element, a needle-type heating element, or a rod-type heating element, and may heat the inside or the outside of the cigarette 20000, according to the shape of the heating element.

Also, the aerosol generating device 10000 may include a plurality of susceptor 15000. Here, the plurality of susceptor 15000 may be inserted into the cigarette 20000 or may be arranged outside the cigarette 20000. Also, some of the plurality of susceptor 15000 may be inserted into the cigarette 20000, and the others may be arranged outside the cigarette 20000. In addition, the shape of the susceptor 15000 is not limited to the shape illustrated in FIG. 1 and may include various shapes.

The aerosol generating device 10000 may further include general-purpose components in addition to the battery 11000, the controller 12000, the coil 14000, and the susceptor 15000. For example, the aerosol generating device 10000 may include a display capable of outputting visual information and/or a motor for outputting haptic information. Also, the aerosol generating device 10000 may include at least one sensor (e.g., a puff detecting sensor, a temperature detecting sensor, a cigarette/a cigarette insertion detecting sensor, etc.).

Also, the aerosol generating device 10000 may be formed such that, even when the cigarette 20000 is inserted into the aerosol generating device 10000, external air may be introduced or internal air may be discharged.

Although not illustrated in FIG. 1, the aerosol generating device 10000 and an additional cradle may form together a system. For example, the cradle may be used to charge the battery 11000 of the aerosol generating device 10000. Also, the susceptor 15000 may be heated when the cradle and the aerosol generating device 10000 are coupled to each other.

The cigarette 20000 may be similar to a general combustive cigarette. For example, the cigarette 20000 may be divided into a first portion 21000 including an aerosol generating material and a second portion 22000 including a filter or the like. Alternatively, the second portion 22000 of the cigarette 20000 may also include an aerosol generating material. For example, an aerosol generating material made in the form of granules or capsules may be inserted into the second portion 22000.

The first portion 21000 may be completely inserted into the aerosol generating device 10000, and the second portion 22000 may be exposed to the outside. In some embodiments, only a portion of the first portion 21000 may be inserted into the aerosol generating device 10000, or a portion of the first portion 21000 and a portion of the second portion 22000 may be inserted thereinto. The user may puff aerosols while holding the second portion 22000 by the mouth of the user. In this case, the aerosol is generated from the external air passing through the first portion 21000, and the generated aerosol passes through the second portion 22000 and is delivered to the user's mouth.

For example, the external air may flow into at least one air passage formed in the aerosol generating device 10000. For example, the opening and closing and/or a size of the air passage formed in the aerosol generating device 10000 may be adjusted by the user. Accordingly, the amount of smoke and a smoking feeling may be adjusted by the user. As another example, the external air may flow into the cigarette 20000 through at least one hole formed in a surface of the cigarette 20000.

Hereinafter, an example of the cigarette 20000 will be described with reference to FIG. 2.

FIG. 2 shows a view showing an example of a cigarette.

Referring to FIG. 2, the cigarette 20000 includes a tobacco rod 21000 and a filter rod 22000. The first portion 21000 described above with reference to FIG. 1 may correspond to the tobacco rod 21000, and the second portion 22000 may correspond to the filter rod 22000.

The filter rod 22000 illustrated in FIG. 2 is illustrated as a single segment, but is not limited thereto. In other words, the filter rod 22000 may include a plurality of segments. For example, the filter rod 22000 may include a first segment configured to cool an aerosol and a second segment configured to filter a certain component included in the aerosol. Also, according to necessity, the filter rod 22000 may further include at least one segment configured to perform other functions.

The cigarette 20000 may be packaged by at least one wrapper 24000, The wrapper 24000 may have at least one hole through which external air may be introduced or internal air may be discharged. For example, the cigarette 20000 may be packaged by one wrapper 24000. As another example, the cigarette 20000 may be doubly packaged by at least two wrappers 24000. For example, the tobacco rod 21000 may be packaged by a first wrapper, and the filter rod 22000 may be packaged by a second wrapper. Also, the tobacco rod 21000 and the filter rod 22000, which are respectively packaged by separate wrappers, may be coupled to each other, and the entire cigarette 20000 may be packaged by a third wrapper. When each of the tobacco rod 21000 and the filter rod 22000 includes a plurality of segments, each segment may be packaged by a separate wrapper. Also, the entire cigarette 20000 including the plurality of segments, which are respectively packaged by the separate wrappers, coupled to each other, and re-packaged by another wrapper.

The tobacco rod 21000 may include an aerosol generating material. For example, the aerosol generating material may include at least one of glycerin, propylene glycol, ethylene glycol, dipropylene glycol, diethylenw glycol, triethylene glycol, tetraethylene glycol, and oleyl alcohol, but it is not limited thereto. Also, the tobacco rod 21000 may include other additives, such as flavors, a wetting agent, and/or organic acid. Also, the tobacco rod 21000 may include a flavored liquid, such as menthol or a moisturizer, which is injected to the tobacco rod 21000.

The tobacco rod 21000 may be manufactured in various forms. For example, the tobacco rod 21000 may be formed as a sheet or a strand. Also, the tobacco rod 21000 may be formed as pipe tobacco, which is formed of tiny bits cut from a tobacco sheet. Also, the tobacco rod 21000 may be surrounded by a heat conductive material. For example, the heat-conducting material may be, but is not limited to, a metal foil such as aluminum foil. For example, the heat conductive material surrounding the tobacco rod 21000 may uniformly distribute heat transmitted to the tobacco rod 21000, and thus, the heat conductivity applied to the tobacco rod may be increased and taste of the tobacco may be improved. Also, the heat conductive material surrounding the tobacco rod 21000 may function as a susceptor heated by the induction heater, Here, although not illustrated in the drawings, the tobacco rod 21000 may further include an additional susceptor, in addition to the heat conductive material surrounding the tobacco rod 21000.

The filter rod 22000 may include a cellulose acetate filter. Shapes of the filter rod 22000 are not limited. For example, the filter rod 22000 may include a cylinder-type rod or a tube-type rod having a hollow inside. Also, the filter rod 22000 may include a recess-type rod. When the filter rod 22000 includes a plurality of segments, at least one of the plurality of segments may have a different shape.

The filter rod 22000 may be formed to generate flavors. For example, a flavoring liquid may be injected onto the filter rod 22000, or an additional fiber coated with a flavoring liquid may be inserted into the filter rod 22000.

Also, the filter rod 22000 may include at least one capsule 23000. Here, the capsule 23000 may generate a flavor or an aerosol. For example, the capsule 23000 may have a configuration in which a liquid containing a flavoring material is wrapped with a film. For example, the capsule 23000 may have a spherical or cylindrical shape, but is not limited thereto.

When the filter rod 22000 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

FIG. 3 is a cross-sectional perspective view of an aerosol generating device according to an embodiment. The descriptions provided above with respect to the aerosol generating device 10000 may also be applied to the aerosol generating device 100 described below.

Referring to FIG. 3, an aerosol generating device 100 may include a battery 110, a controller 120, a housing 130, and a heat dissipating structure 160. Although not shown in FIG. 3, a coil and a susceptor for heating a cigarette 20 may be arranged inside the heat dissipating structure 160, and a detailed configuration related thereto will be described later.

The housing 130 may constitute the appearance of the aerosol generating device 100. Also, the housing 130 may include an opening 131 through which the cigarette 20 is inserted. An accommodation space 132 in which the cigarette 20 is accommodated may be formed in the housing 130.

In the embodiment shown in FIG. 3, the heat dissipating structure 160 may have a cylindrical shape, and when the cigarette 20 is accommodated in the accommodation space 132, the heat dissipating structure 160 may surround the cigarette 20. However, the shape of the heat dissipating structure 160 is not limited to the above description, and the heat dissipating structure 160 may have a different shape suitable for accommodating the cigarette 20. For example, the heat dissipating structure 160 may be a tubular shape having a polygonal cross-section or a tubular shape having an oval cross-section.

The heat dissipating structure 160 may have a double wall structure having an inner wall 161 and an outer wall 162. However, the wall structure of the heat dissipating structure 160 is not limited thereto and may have other multi-wall structures as needed. Referring to FIG. 3, the heat dissipating structure 160 may include an inner wall 161 that surrounds the accommodation space 132, and an outer wall 162 disposed between the inner wall 161 and the housing 130. Thus, an inner space 163 may be formed between the inner wall 161 and the outer wall 162 of the heat dissipating structure 160.

Also, the heat dissipating structure 160 may include an upper wall and a lower wall that connect the inner wall 161 and the outer wall 162. The inner space 163 formed by the inner wall 161, the outer wall 162, the upper wall, and the lower wall of the heat dissipating structure 160 may be a vacuum space. Thus, since heat transfer through the inner space 163 is effectively blocked, heat transferred to the inner wall 161 may be blocked from passing through the inner space 163 toward the outside of the outer wall 162.

In order to maintain the inner space 163 of the heat dissipating structure 160 in a vacuum state, the inner wall 161, the outer wall 162, the upper wall, and the lower wall of the heat dissipating structure 160 may be airtightly coupled. Here, the vacuum state may refer to a relative vacuum state of having relatively less air amount compared to surroundings or refer to an absolute vacuum state of having no air. For example, the inner wall 161, the outer wall 162, the upper wall and the lower wall may be manufactured separately and combined airtightly. Alternatively, the inner wall 161, the outer wall 162, the upper wall and the lower wall may be integrally formed.

FIG. 4A is a detailed cross-sectional view of a portion of the aerosol generating device shown in FIG. 3, and FIG. 4B illustrates an induced magnetic field according to an embodiment. FIG. 4C is a detailed cross-sectional view of a portion of an aerosol generating device according to another embodiment.

Referring to FIG. 4A, the aerosol generating device 100 may include a coil 140 disposed inside the heat dissipating structure 160, a susceptor 150, and a shielding portion 170.

As described above, the coil 140 may generate an induced magnetic field and surround the accommodation space 132. The susceptor 150 may generate heat by the induced magnetic field generated from the coil 140 and may heat the cigarette 20 accommodated in the accommodation space 132.

Also, the coil 140 may be disposed inside the heat dissipating structure 160, and may be apart from the heat dissipating structure 160 by a certain distance d. For example, the certain distance d between the coil 140 and the heat dissipating structure 160 may be 1 mm to 2 mm.

As shown in FIG. 4A, the susceptor 150 may have a shape of a rod having a pointy tip such that the susceptor 150 may be inserted into the cigarette 20, but embodiments are not limited thereto. For example, referring to FIG. 4C, a susceptor 150' of the aerosol generating device 100 may not be inserted into the cigarette 20 but may be arranged outside the cigarette 20. Thus, the susceptor 150' may heat the outside of the cigarette 20 to generate an aerosol.

Also, the aerosol generating device 100 may include a support 151 for supporting the susceptor 150 and a first support wall 152 connected to the support 151 and forming the accommodation space 132. The support 151 and the first support wall 152 may be manufactured separately and airtightly coupled to each other. Alternatively, the support 151 and the first support wall 152 may be integrally formed. The coil 140 may surround the first support wall 152 such that the susceptor 150 is disposed inside the coil 140.

The shielding portion 170 may block the induced magnetic field generated from the coil 140. As shown in FIG. 4B, the induced magnetic field generated from the coil 140 is blocked by the shielding portion 170 and thus is formed only inside the coil 140. Thus, the induced magnetic field generated from the coil 140 may be concentrated to the susceptor 150. Although FIG. 4B illustrates the induced magnetic field generated only at one side of the coil 140, the induced magnetic field may be generated in the same manner at the other side of the coil 140.

For example, the shielding portion 170 may be formed of a material that may block the induced magnetic field, such as a nano crystal or a ferrite sheet. However, the material of the shielding portion 170 is not limited thereto.

The shielding portion 170 may be arranged in a space formed between the coil 140 and the heat dissipating structure 160, surrounding the coil 140. Thus, the shielding portion 170 may prevent the induced magnetic field generated by the coil 140 from being dissipated to the outside of the aerosol generating device 100. In this case, the shielding portion 170 may be adjacent to the coil 140.

Since the shielding portion 170 is adjacent to the coil 140 in the space between the coil 140 and the heat dissipating structure 160, an air gap may be formed between the heat dissipating structure 160 and the shielding portion 170. Thus, the induced magnetic field leaking out of the shielding portion 170 may be prevented from reaching the heat dissipating structure 160 due to an air gap formed between the heat dissipating structure 160 and the shielding portion 170. Simultaneously, since heat generated from the susceptor 150 is dispersed through the air gap, heat reaching the heat dissipating structure 160 may be reduced.

The above-described heat dissipating structure 160 may comprise a metal material. For example, the heat dissipating structure 160 may comprises a paramagnetic metal including stainless steel, aluminum, potassium, sodium, platinum, steel use stainless (SUS), and the like. Even when the heat dissipating structure 160 comprises a paramagnetic substance, the heat dissipating structure 160 may generate heat by the induced magnetic field generated from the coil 140. For this reason, the shielding portion 170 may be arranged between the coil 140 and the heat dissipating structure 160.

Also, since the heat dissipating structure 160 formed of the metal structure may absorb the induced magnetic field that passes through the shielding portion 170 and the air gap described above, the effect of blocking electromagnetic waves may be maximized.

Also, the heat dissipating structure 160 may be formed of a non-metal material. In this case, electromagnetic induction may not occur by the induced magnetic field of the coil 140, and thus heat is not generated by the induced magnetic field. Thus, in this case, the heat dissipating structure 160 made of the non-metal material may receive only heat generated from the susceptor 150. Thus, if an appropriate air gap is formed as described above, heat transferred to the heat dissipating structure 160 may be reduced. However, in this case, the blocking effect of the induced magnetic field of the heat dissipating structure 160 is reduced compared to the case where the heat dissipating structure 160 comprises metal. For this reason, the shielding portion 170 may be arranged outside the coil 140.

According to one or more embodiments, the shielding portion 170 and the heat dissipating structure 160 are arranged together so that electromagnetic waves of the aerosol generating device 100 may be prevented from being propagated to the outside, and simultaneously heat generated from the inside of the aerosol generating device 100 may be prevented from being transferred to the outside.

FIG. 5A is a detailed cross-sectional view of a portion of an aerosol generating device according to another embodiment, and FIG. 5B is a detailed cross-sectional view of an aerosol generating device according to another embodiment.

Referring to FIG. 5A, an aerosol generating device 200 may include a support 251 for supporting a susceptor 250, a first support wall 252 connected to the support 251 and forming an accommodation space 232, a second support wall 253 that is apart from and arranged outside the first support wall 252, and a connection wall 254 connecting the first support wall 252 and the second support wall 253.

Since the first support wall 252 and the second support wall 253 are apart from each other, a coil accommodation space in which the coil 240 may be accommodated, may be formed. The coil 240 may be fixed in the coil accommodation space.

After the support 251, the first support wall 252, the second support wall 253, and the connection wall 254 may be separately manufactured and airtightly coupled to one another. Alternatively, the support 251, the first support wall 252, the second support wall 253, and the connection wall 254 may be integrally formed.

The shielding portion 270 may be adjacent to the second support wall 253. Thus, the shielding portion 270 may be adjacent to the coil 240.

The heat dissipating structure 260 may have a double wall structure having an inner wall 261 and an outer wall 262. As described above, an air gap may be formed between the heat dissipating structure 260 and the shielding portion 270. Thus, the induced magnetic field leaking out of the shielding portion 270 may be prevented from reaching the heat dissipating structure 260 due to the air gap formed between the heat dissipating structure 260 and the shielding portion 270. Simultaneously, heat generated from the susceptor 260 is dispersed in the process of passing through the air gap, heat reaching the heat dissipating structure 260 may be reduced.

Referring to FIG. 5B, contrary to FIG. 5A, a shielding portion 270' may be adjacent to the inner wall 261 of the heat dissipating structure 260. Thus, an air gap may be formed between the coil 240 and the shielding portion 270'. Thus, since the induced magnetic field generated from the coil 240 and the heat generated by the susceptor 250 are dispersed through the air gap due, the induced magnetic field reaching the shielding portion 270' and heat reaching the heat dissipating structure 260 may be reduced.

FIG. 6 is a detailed cross-sectional view of a portion of an aerosol generating device according to another embodiment.

Referring to FIG. 6, an aerosol generating device 300 may include a cigarette recognition sensor 380 that detects insertion or extraction of the cigarette. The aerosol generating device 300 may include a support 351 for supporting a susceptor 350, a first support wall 352 connected to the support 351 and forming an accommodation space 332, a second support wall 353 that is apart from and arranged outside the first support wall 352, and a connection wall 354 connecting the first support wall 352 and the second support wall 353. The heat dissipating structure 360 may have a double wall structure having an inner wall 361 and an outer wall 362.

The cigarette recognition sensor 380 may detect whether the cigarette has been inserted into an accommodation space 332. The cigarette recognition sensor 380 may detect changes in inductance generated by inserting or extracting the cigarette. For example, the cigarette recognition sensor 380 may include a detection coil (not shown) and may output an inductance value based on a frequency value that changes according to insertion or extraction of the cigarette.

To this end, the cigarette 20 may include an electromagnetic inducer (not shown), for example. The electromagnetic inducer may change inductance of the cigarette recognition sensor 380. The electromagnetic inducer may include a conductor that may induce an eddy current, and a magnetic material that may change magnetic flux. For example, the electromagnetic inducer may include a metal material, a magnetic ink, a magnetic tape, and the like. Also, the electromagnetic inducer may be a metal material such as aluminum. However, embodiments are not limited thereto, and the electromagnetic inducer may include materials that change the inductance of the cigarette recognition sensor 380 without limitations.

As shown in FIG. 6, the cigarette recognition sensor 380 may be arranged between a coil 340 and a shielding portion 370. Since the cigarette recognition sensor 380 recognizes the cigarette by the electromagnetic inducer of the cigarette, if the cigarette recognition sensor 380 is disposed outside the shielding portion 370, insertion or extraction of the cigarette may not be detected. Thus, with the cigarette recognition sensor 380 disposed inside the shielding portion 370, in particular, between the coil 340 and the shielding portion 370, insertion or extraction of cigarette may be detected.

A controller may determine whether the cigarette 20 had been inserted or extracted, based on changes in inductance of the cigarette recognition sensor 380.

For example, when the controller detects insertion of the cigarette, a heating operation may be automatically performed without an additional external input. Specifically, when the controller detects that the cigarette has been inserted, using the cigarette recognition sensor 380, the controller may control to supply power to the coil 340 from a battery. As an induced magnetic field is generated by the coil 340, the susceptor 350 may be heated. Thus, the cigarette may be heated by the susceptor 350 and thus, an aerosol may be generated.

Also, when the controller detects extraction of the cigarette, the heating operation may be automatically stopped without an additional external input. Specifically, when the controller detects that the cigarette has been extracted, using the cigarette recognition sensor 380, the controller may cut off the power supplied to the coil 340 from the battery.

At least one of the components, elements, (nodules or units (collectively "components" in this paragraph) represented by a block in the drawings such as the controller in FIGS. 1 and 3 may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

INDUSTRIAL APPLICABILITY

One or more embodiments relate to an aerosol generating device and an aerosol generating system including a heat dissipating structure and a shielding portion that may prevent heat and electromagnetic waves from being transferred to the outside of the device.

The invention claimed is:

1. An aerosol generating device comprising:
- an opening configured to receive a cigarette;
- an accommodation space configured to accommodate the cigarette inserted through the opening;
- a coil surrounding the accommodation space and configured to generate an induced magnetic field;
- a susceptor configured to generate heat due to the induced magnetic field generated from the coil;
- a heat dissipating structure surrounding the coil and having a double wall structure including a vacuum inner space; and
- a shielding portion configured to block the induced magnetic field generated from the coil and disposed between the coil and the heat dissipating structure,
- wherein the heat dissipating structure comprises a metal material, and
- wherein an air gap is formed between the heat dissipating structure and the shielding portion or between the coil and the shielding portion.

2. The aerosol generating device of claim 1, wherein the shielding portion is adjacent to the coil.

3. The aerosol generating device of claim 1, further comprising:
- a support configured to support the susceptor; and
- a first support wall connected to the support and forming the accommodation space,
- wherein the coil surrounds the first support wall.

4. The aerosol generating device of claim 3, further comprising a second support wall apart from and arranged outside the first support wall such that a coil accommodation space is formed between the first support wall and the second support wall,
- wherein the coil is arranged in the coil accommodation space.

5. The aerosol generating device of claim 4, wherein the shielding portion is adjacent to the second support wall.

6. The aerosol generating device of claim 1, wherein the shielding portion is adjacent to the heat dissipating structure.

7. The aerosol generating device of claim 1, wherein a distance between the coil and the heat dissipating structure is 1 mm to 2 mm.

8. The aerosol generating device of claim 1, wherein the metal material of the heat dissipating structure is a paramagnetic substance.

9. The aerosol generating device of claim 1, further comprising:

a cigarette recognition sensor configured to detect changes in inductance which is generated by insertion or extraction of the cigarette; and a controller configured to determine whether the cigarette is inserted or extracted, based on the changes in inductance.

10. The aerosol generating device of claim 9, wherein the cigarette recognition sensor is arranged between the coil and the shielding portion.

11. The aerosol generating device of claim 9, further comprising a battery configured to supply power to the coil, wherein the controller is further configured to control the power supplied to the coil based on insertion or extraction of the cigarette.

12. An aerosol generating system comprising:

a cigarette comprising an aerosol generating material; and an aerosol generating device configured to accommodate the cigarette and comprising:

an opening configured to receive the cigarette;

an accommodation space configured to accommodate the cigarette inserted through the opening;

a coil surrounding the accommodation space and configured to generate an induced magnetic field;

a susceptor configured to generate heat due to the induced magnetic field generated from the coil;

a heat dissipating structure surrounding the coil and having a double wall structure including a vacuum inner space; and a shielding portion configured to block the induced magnetic field generated from the coil and disposed between the coil and the heat dissipating structure, wherein the heat dissipating structure comprises a metal material, and wherein an air gap is formed between the heat dissipating structure and the shielding portion or between the coil and the shielding portion.

13. The aerosol generating system of claim 12, wherein the aerosol generating device further comprises:

a cigarette recognition sensor arranged between the shielding portion and the coil and configured to detect changes in inductance generated by insertion or extraction of the cigarette; and a controller configured to determine whether the cigarette has been inserted or extracted, based on the changes in inductance.

14. The aerosol generating system of claim 13, wherein the cigarette comprises an electromagnetic inducer configured to change the inductance of the cigarette recognition sensor.

* * * * *